US009810455B2

(12) United States Patent
Kaiser

(10) Patent No.: US 9,810,455 B2
(45) Date of Patent: Nov. 7, 2017

(54) HEAT AND ENERGY RECOVERY AND REGENERATION ASSEMBLY, SYSTEM AND METHOD

(71) Applicant: GASN, LLC, Boca Raton, FL (US)

(72) Inventor: Stewart Kaiser, Boca Raton, FL (US)

(73) Assignee: GASN LLC, Boca Raton, FL (US)

( * ) Notice: Subject to any disclaimer, the term of this patent is extended or adjusted under 35 U.S.C. 154(b) by 1243 days.

(21) Appl. No.: 13/753,585

(22) Filed: Jan. 30, 2013

(65) Prior Publication Data

US 2014/0209271 A1 Jul. 31, 2014

(51) Int. Cl.

| | |
|---|---|
| ***F24H 3/12*** | (2006.01) |
| ***F25B 29/00*** | (2006.01) |
| ***F24D 19/10*** | (2006.01) |
| ***F24H 3/06*** | (2006.01) |
| ***F24D 5/04*** | (2006.01) |

(52) U.S. Cl.

CPC ..... *F25B 29/00* (2013.01); *F24D 5/04* (2013.01); *F24D 19/1084* (2013.01); *F24H 3/065* (2013.01); *F24D 2200/18* (2013.01); *F24D 2200/22* (2013.01); *F24D 2220/06* (2013.01)

(58) Field of Classification Search

CPC .. F25B 29/00; F24D 2200/01; F24D 2200/18; F24D 2200/22; F24D 2200/06

USPC ..... 237/50

See application file for complete search history.

(56) References Cited

U.S. PATENT DOCUMENTS 3,917,444 A * 11/1975 Carthew ..... B01J 6/00 165/909
4,141,490 A * 2/1979 Franchina ..... F24D 11/0278 126/110 R
4,267,884 A 5/1981 Gary
4,287,723 A * 9/1981 Dosmond ..... F24D 3/18 237/2 B
4,497,439 A * 2/1985 Ben-Shmuel ..... B01D 53/34 122/7 R
4,523,438 A * 6/1985 Curti ..... F24D 3/18 237/2 B
4,616,697 A * 10/1986 Kotaka ..... F23D 14/66 165/104.14
4,651,923 A * 3/1987 Ben-Shmuel ..... F23J 11/00 122/20 B (Continued)

FOREIGN PATENT DOCUMENTS

CN 101718502 6/2010
EP 1607687 A2 12/2005

OTHER PUBLICATIONS

International Search Report, International Application No. PCT/US2013/060102, dated Feb. 18, 2014 (1 page).
European Searching Authority; Supplementary European Search Report and Written Opinion dated Oct. 7, 2016; entire document.

*Primary Examiner* — Avinash Savani
*Assistant Examiner* — Deepak Deean
(74) *Attorney, Agent, or Firm* — Allen Dyer Doppelt & Gilchrist

(57) ABSTRACT

The present invention is directed to a heat and energy recovery assembly, system and method. The heat and energy recovery assembly and system may include an insulated chamber for effectuating heat and energy exchange between a primary heat recovery exchanger and the reaction products of fossil fuel combustion gases, waste products, and air. The heat and energy recovery assembly and system are particularly useful on furnace systems.

15 Claims, 10 Drawing Sheets

(56) References Cited

U.S. PATENT DOCUMENTS

| | | | | |
|---|---|---|---|---|
| 4,687,133 | A * | 8/1987 | Karlstedt | F24D 5/12 237/2 B |
| 4,784,069 | A | 11/1988 | Stark | |
| 4,989,781 | A | 2/1991 | Guyer et al. | |
| 5,607,011 | A * | 3/1997 | Abdelmalek | B01D 53/002 165/104.14 |
| 5,632,143 | A | 5/1997 | Fisher et al. | |
| 5,868,562 | A | 2/1999 | Watanabe et al. | |
| 6,779,735 | B1 * | 8/2004 | Onstott | F24F 12/006 165/248 |
| 7,575,178 | B2 | 8/2009 | Loewen et al. | |
| 8,011,598 | B2 * | 9/2011 | Kelly | F24D 12/02 237/12.1 |
| 2008/0261093 | A1 * | 10/2008 | Kelly | F24D 12/02 429/415 |
| 2013/0312945 | A1 * | 11/2013 | Karlstedt | F28F 27/00 165/279 |

* cited by examiner

HEAT AND ENERGY RECOVERY AND REGENERATION ASSEMBLY, SYSTEM AND METHOD

FIELD OF THE INVENTION

This invention relates generally to the field of air conditioning and heating systems; more particularly, it concerns a system for efficiently combusting fossil fuels for heating a space.

BACKGROUND OF THE INVENTION

The standard methodology used in utilizing fossil fuels for heating is firing the fuel in a controlled heating chamber or heat exchanger. The heat created by the burning fuel is drawn away by air or water flowing around the outside of the heat exchanger. This can be accomplished by blower fans or pumps. The heat is transferred into the surrounding air or water, heating the conditioned space. The waste or emissions from the combustion reaction is allowed to flow outdoors usually utilizing flue piping to a chimney or stack. The efficiency of the furnace or boiler is calculated by the amount of heat which can be extracted from the heat exchanger and utilized to heat the conditioned space and the percentage of heat and by-products permitted to escape through the flue to be vented outside. This rating or efficiency quantification is placed on the furnace or boiler to depict how efficient it will be.

Releasing carbon and heat saturated emissions into the atmosphere contribute to environmental problems, such as global warming. Not only does carbon monoxide and carbon dioxide add to blanketing the release of heat into space, discharging heat through flue gas emissions adds to this issue by heat pollution. Just an average low to medium efficient residential natural gas, LPG or oil furnace can emit one million BTU's of heat waste into the atmosphere each day. Commercial and industrial units can discharge hundreds of millions, and occasionally billions, of BTU's per unit per day. In addition, these common and traditional methods of discharging the flue gas into the atmosphere are wasteful and inefficient.

SUMMARY OF THE INVENTION

In at least one embodiment, the invention is directed to a heat and energy recovery assembly. The present invention is advantageous over traditional HVAC systems in that it produces less greenhouse gases and further utilizes heat that is typically released into the environment. The assembly or apparatus may include a chamber, preferably insulated, comprising an air intake and an emissions intake. The emissions intake is structurally adapted to receive exhaust gas and waste products emitted as a result of fuel combustion. The assembly or apparatus may also include an exhaust for discharging remaining emissions from the chamber.

The chamber additionally includes a primary heat recovery exchanger contained within the chamber, which is in fluid communication with a fluid circuit that includes a primary conduit configured to convey a fluid therein. The primary heat recovery exchanger is disposed within the chamber such that during normal operation when exhaust gas and waste products and air are introduced, it is in thermal communication with the resulting mixture. As a result, heat exchange is effectuated with the fluid inside the exchanger and fluid circuit. A heat extraction exchanger is also in fluid communication with the fluid circuit and primary heat recovery exchanger and disposed in thermal communication with an airstream to be heated, such that heat is transferred from the heat extraction exchanger into the stream of air.

In another embodiment, the invention is directed to a heat and energy recovery system for a furnace. The system includes an insulated chamber comprising an air intake and an emissions intake. The emissions intake is in communication with the furnace exhaust to receive exhaust gas and waste products resulting from fuel combustion in the furnace. The air intake is configured for receiving air from a source of air, such as indoor or outdoor air. A primary heat recovery exchanger is contained within the insulated chamber and is in fluid communication with a fluid circuit that includes a conduit configured to convey a fluid therein. The primary heat exchanger is also configured such that during operation of the furnace it is in thermal communication with a mixture comprising air introduced via the air intake and exhaust gas and waste products introduced via the emissions intake, such that heat exchange is effectuated with the fluid. The system also includes a heat extraction exchanger in fluid communication with the fluid circuit and disposed in thermal communication with an airstream being drawn into the furnace for transferring heat energy from the exchanger to the airstream.

In at least one embodiment, the assembly and system of the present invention may further include a heat recovery ventilator assembly. The assembly provides an outdoor air intake in communication with the heat extraction exchanger such that outdoor air is drawn into the assembly and pushed across the heat extraction exchanger to heat the outdoor air as it is drawn into an air heating apparatus, such as a furnace.

The invention is further directed to a method of recovering heat and energy from fossil fuel combustion waste products. The method includes feeding excess heat and waste products emitted as a result of fuel combustion into an insulated chamber which contains a primary heat recovery exchanger, which contains fluid within, coupled with a fluid containing conduit circuit. The method further includes feeding air into the insulated chamber to initiate a reaction with the waste products that produces a reaction product with potential energy. Furthermore, the method includes effectuating heat energy exchange through the reaction product and excess heat interacting with the primary heat recovery exchanger. As a result, the temperature and reactive pressure within the first fluid-filled heat exchanger and fluid containing conduit circuit rises. Finally, the method includes releasing the heat energy by forced air blowing over a heat extraction exchanger that is in fluid communication with the fluid containing conduit circuit exteriorly of the insulated chamber.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As illustrated in the accompanying drawings, the present invention is directed to a heat and energy recovery assembly and system, in addition to methods of using the same. Such heat recovery devices may be adapted for use in a furnace of an HVAC system or any other system where heat energy from fuel combustion is utilized for heating air spaces.

Figure 1:
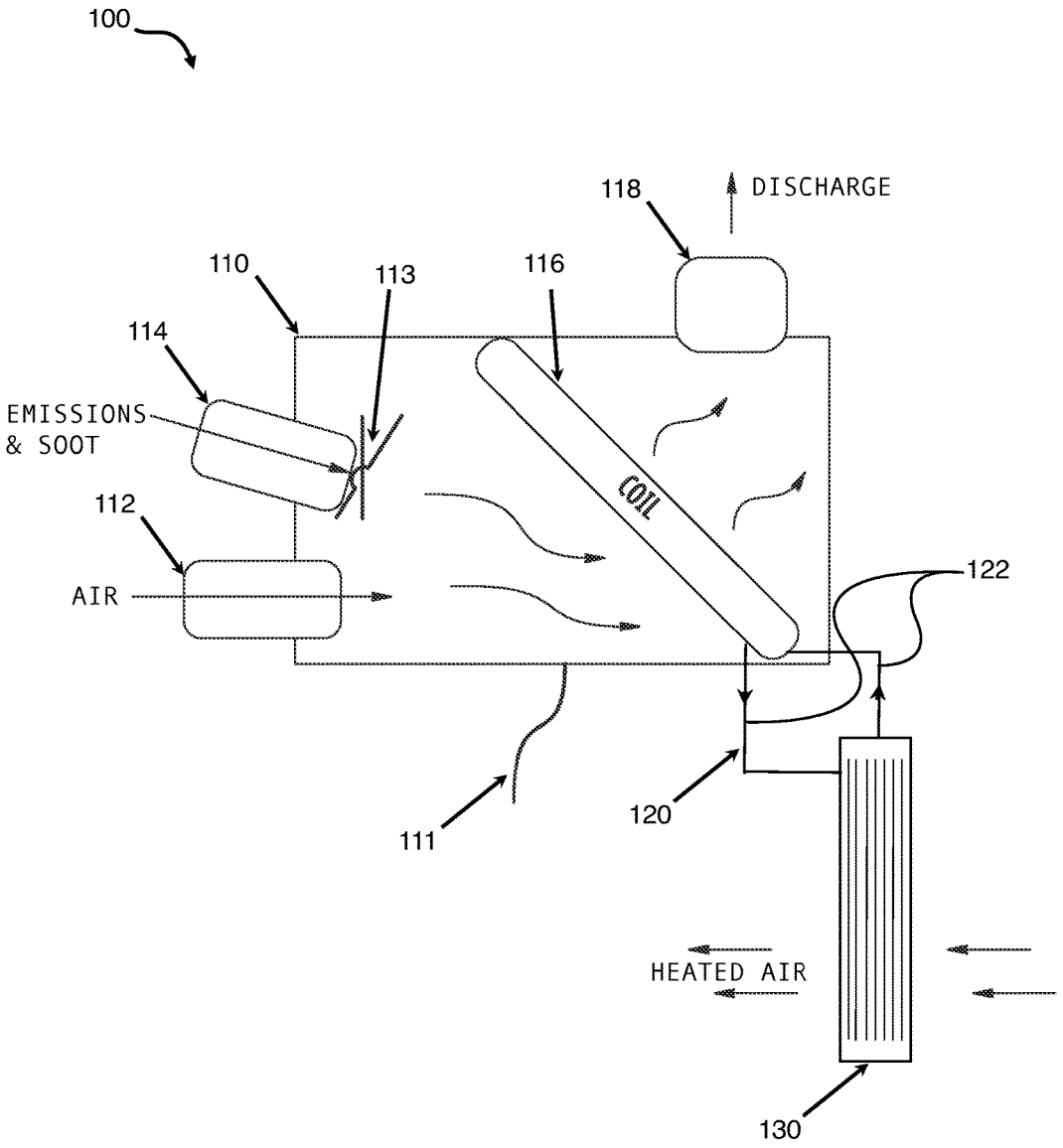
FIG. 1 is an illustration of one embodiment of a heat recovery assembly of the present invention.

In one embodiment of the invention, a heat recovery assembly 100 is provided, as illustrated in FIG. 1. The assembly 100 includes an insulated chamber 110, or heat recovery box, which comprises an air intake 112 and an emissions intake 114 for receiving exhaust gas and waste products emitted as a result of fuel combustion. The insulated chamber may be made from a variety of metals or alloys. Preferably, the insulated chamber 110 is made of stainless steel and titanium alloy.

The assembly 100 further includes a primary heat recovery exchanger 116 contained within the insulated chamber. The primary heat recovery exchanger 116 is structured for contacting a mixture made up of air introduced via the air intake 112 and exhaust gas and waste products (made up of oxygen starved, carbon emissions) introduced via the emissions intake 114. A coil sensor may also be in contact with the primary heat recovery exchanger 116 to relay any problems with the functionality of the exchanger to a central logic board (discussed later herein). The primary heat recovery exchanger 116 may be made from a variety of metals and alloys that are ideal for heat exchange, such as but not limited to, copper, aluminum and the like. The exchanger 116 may also be in the form of a hermetically sealed heat recovery coil.

Figure 4:
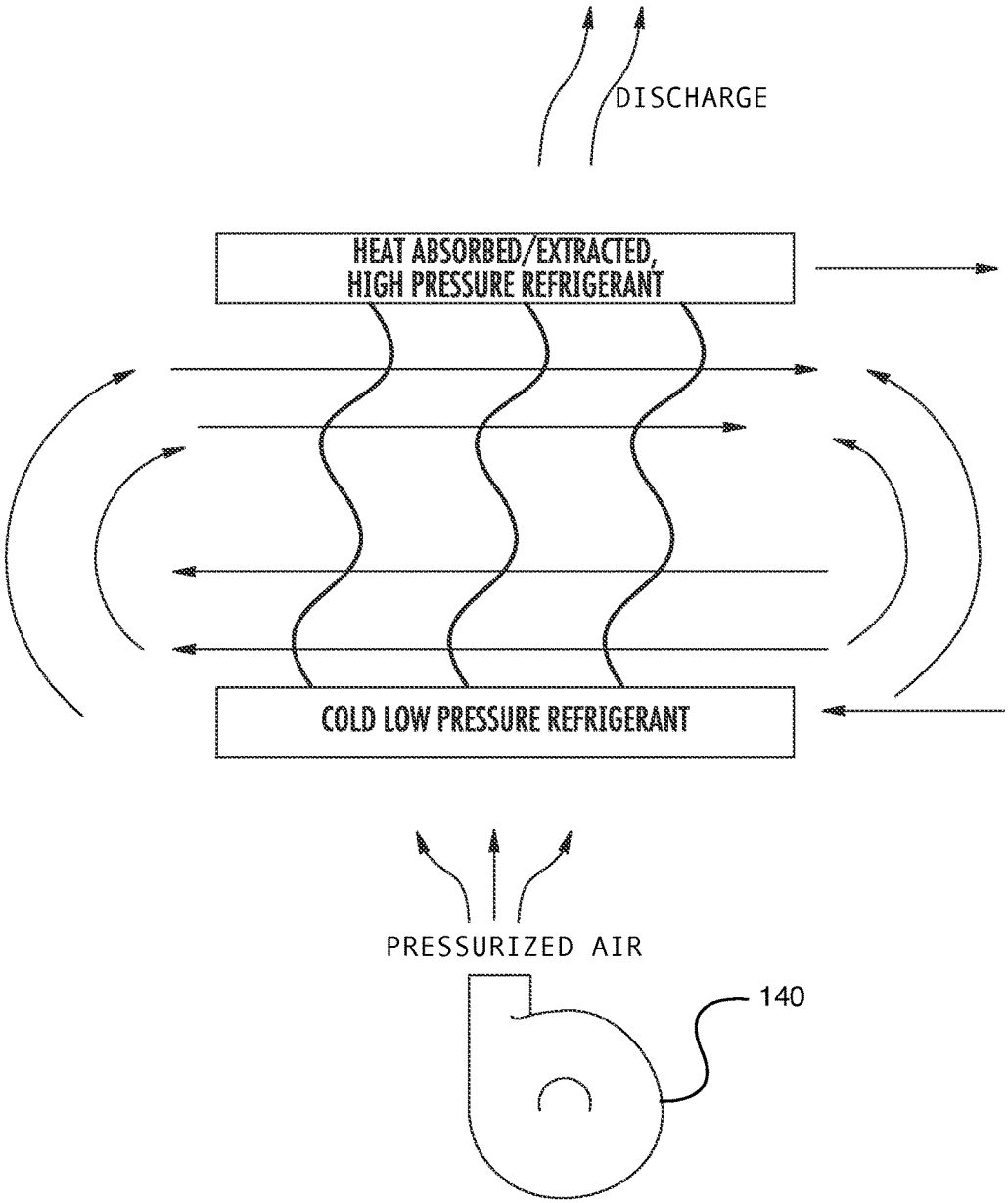
FIG. 4 is an illustration of the heat exchange process utilized in the embodiments of a heat recovery assembly of FIGS. 1 and 2.

The air intake 112 may be structured as a single intake or multiple intakes. The intake(s) may be adapted to introduce outdoor air, indoor air or both. Additionally, in some embodiments it may be desirable to generate a pressurized environment within the insulated chamber 110; therefore, one or more of the air intake(s) 112 may connect to a pressure regulator inducer blower 140 (see FIG. 4) that is part of a pressure equalization system to assist in pressurizing the air inside the insulated chamber 110. The inducer blower 140 may also be a variable speed motor that is controlled by sensors that detect proper temperature and/or humidity and/or pressure of the air inside the insulated chamber 110.

The primary heat recovery exchanger 116 is further interconnected to a fluid circuit 120 containing a primary conduit 122 for conveying fluid therein. The assembly 100 may also be interconnected to a heat extraction exchanger 130 exteriorly of the insulated chamber 110 such that the heat extraction exchanger 130 is in fluid communication with the fluid circuit 120 via the primary conduit 122. The heat extraction exchanger 130 and the primary heat recovery exchanger 116 are collectively interconnected via the primary conduit 122 of the fluid circuit 120 such that the primary heat recovery exchanger 116 contacts (within the insulated chamber 110) the mixture made up of air introduced via the air intake 112 and exhaust gas and waste products introduced via the emissions intake 114, while the heat extraction exchanger 130 contacts air to be heated, outside of the insulated chamber 110.

The insulated chamber 110 additionally comprises exhaust and drainage components. An exhaust 118 for discharging the remaining exhaust gas and waste products after heat exchange occurs is structured to interconnect the insulated chamber 110 to the outside environment. Furthermore, a drain 111 may be connected to the insulated chamber 110 to carry condensate with ash out of the chamber 110. The drain 111 is particularly necessary when a mister 113 is included in the insulated chamber 110. A mister 113 is utilized to saturate the air within the insulated chamber 110 with moisture and to help capture and remove particulates and ash soot from the exhaust gases by them becoming saturated with water from the flash heat steam from the super heated oil combustion emissions and falling to the bottom of the chamber to be discharged through the drain 111. The mister 113 is typically connected to a pressurized water tube to provide water to the insulated chamber 110 to raise the dew point within the chamber 110 to raise the heat transfer potential.

The embodiment illustrated in FIG. 1 is typically designed for use when the input exhaust originates from the burning of cleaner burning propane or other natural gases, such as but not limited to, a natural gas-burning furnace component of a heating, ventilation and air conditioning (HVAC) unit. However, it would be understood by those skilled in the art that the assembly 100 could be utilized in other situations where the surrounding air is to be heating by fossil fuel combustion.

Figure 2:
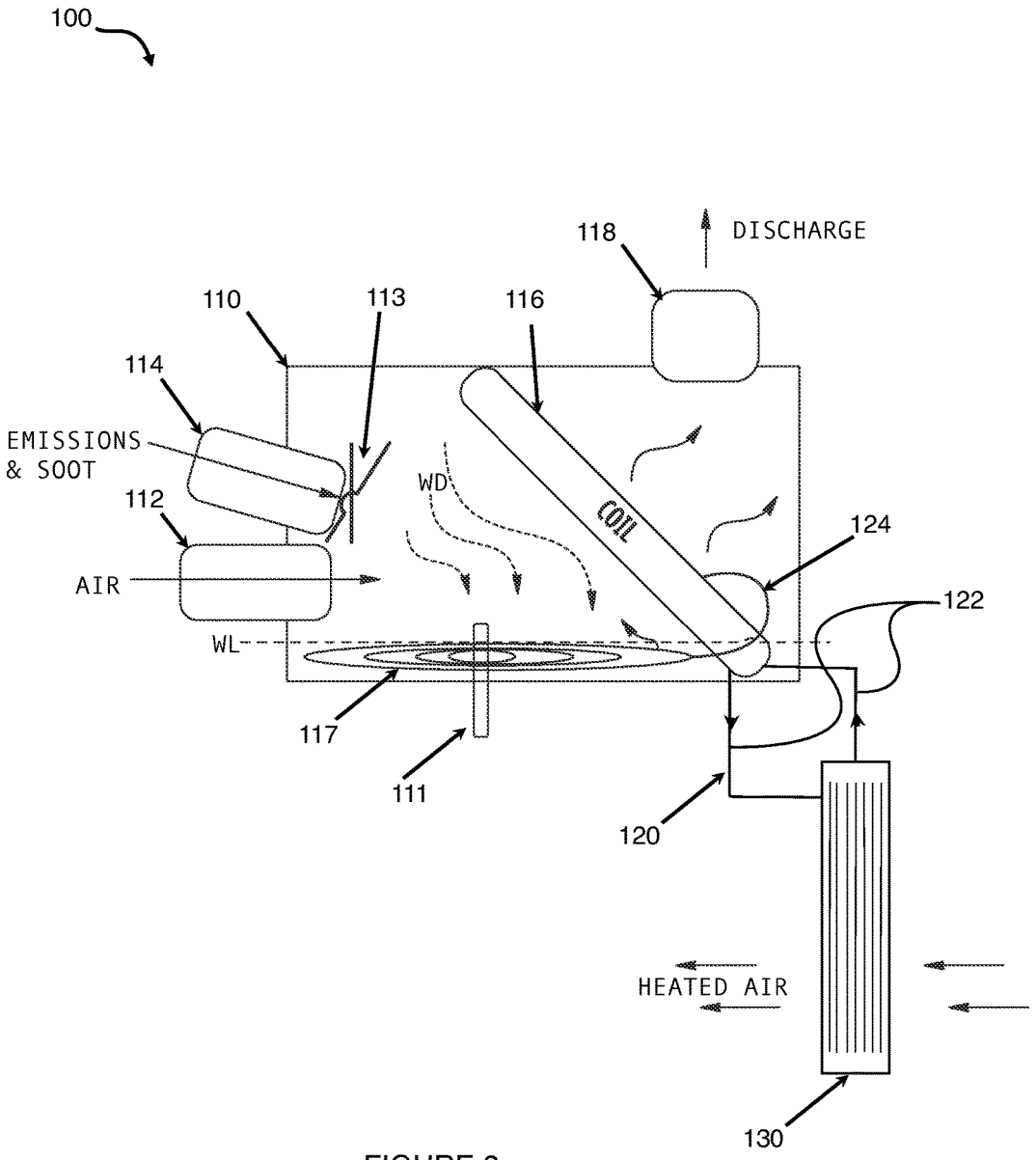
FIG. 2 is an illustration of another embodiment of a heat recovery assembly of the present invention.

FIG. 2 illustrates an embodiment of the assembly 100 of the present invention that is particularly useful for when the input exhaust originates from an oil-burning furnace; however, this embodiment may be utilized in place of the embodiment illustrated in FIG. 1 for burning natural gas sources as well. The components and configuration of this embodiment are generally the same as in FIG. 1; however, additional aspects are included for capturing the heat that is stored in the water condensate that accumulates at the bottom of the insulated chamber 110. The embodiment illustrated in FIG. 2 includes a secondary heat recovery exchanger 117 in fluid communication with the primary heat recovery exchanger 116 via a secondary conduit 124 for absorbing the excess heat stored in the water as it accumulates from the condensate produced by the mister 113 reacting with the mixture of air and hot emissions and soot to produce super heated water droplets, WD. Since the secondary conduit 124 is in communication with the primary heat recovery exchanger 116, the secondary heat recovery exchanger 117 is further in fluid communication with the fluid circuit 120 as a whole. The drain 111 in FIG. 2 is shown to be structured such that water and condensate ash/soot does not drain from the insulated chamber 110 until the water rises to a certain level, WL. This allows the secondary heat recovery exchanger 117 to remain underneath the surface of the water as it absorbs the excess heat energy stored in the condensate water to ensure that very little, or none, of the heat energy remains unabsorbed in the entire process.

During operation of the assembly and/or system of the present invention, hot emissions (carbon monoxide, carbon dioxide, $H_2O$, etc.) are exhausted into the insulated chamber 110. Fresh, outdoor or indoor air is pressurized into the chamber to mix with the emissions. A large, cubic foot print of air is saturated and heated as a result. This mixture flows across the primary heat recovery exchanger 116 while the dew point rises, holding water and heat (saturation). The heat is then extracted from the mixture via the primary heat recovery exchanger 116 (including the secondary heat recovery exchanger 117 if the embodiment illustrated in FIG. 2 is utilized) and transferred to the heat extraction exchanger 130 such that heat transfer occurs to heat indoor air. Cooler, dry air is exported outdoors with a reduced heat, moisture and carbon content. This process allows heat energy to be pulled from the ambient air introduced into the insulated chamber such that it is compounded with the heat energy already being produced by the fossil fuel combustion process. This then gives the assembly and system the potential to achieve a higher efficiency of fuel burn.

Figure 3:
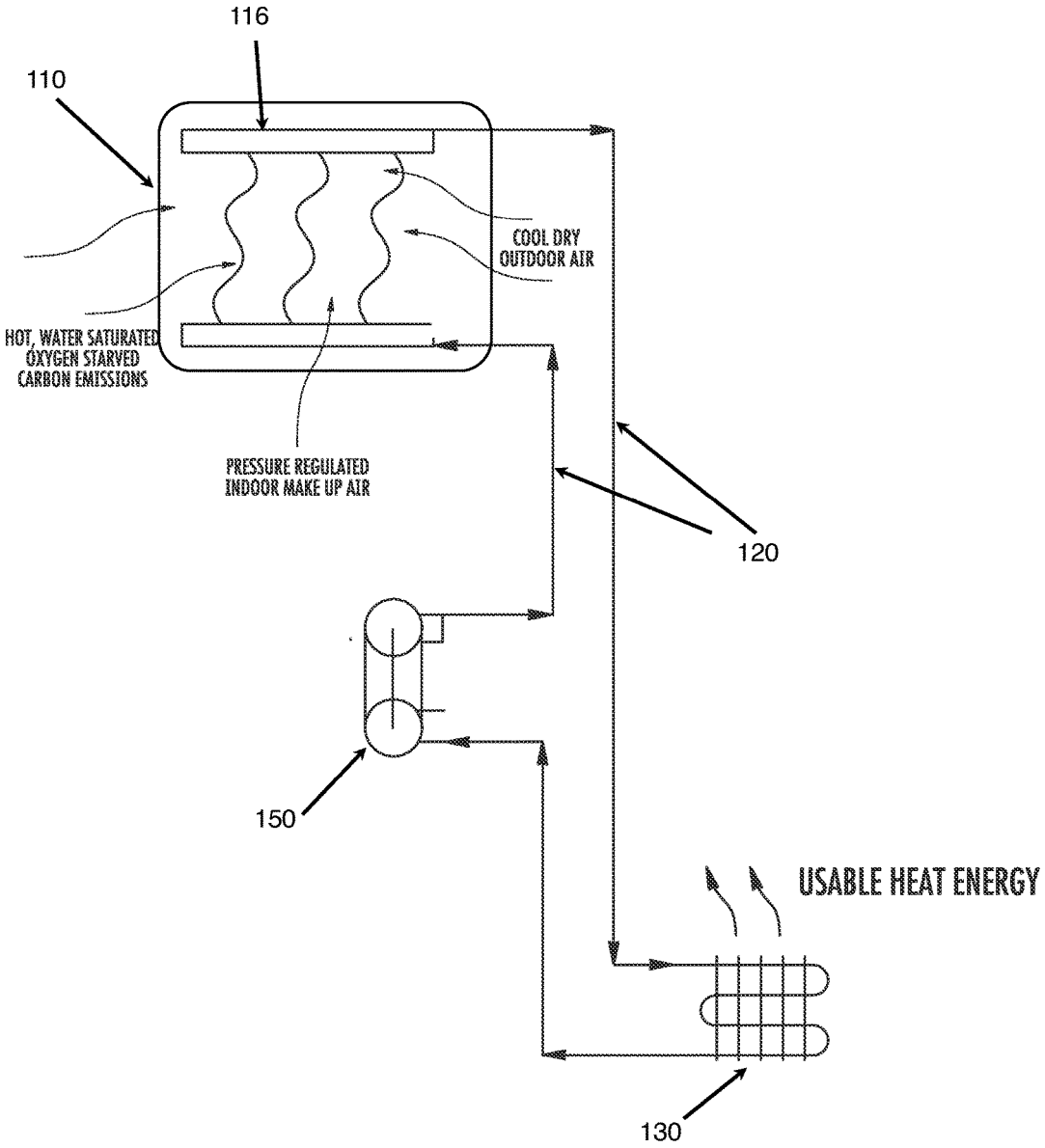
FIG. 3 is an illustration of the functionality of the embodiments of a heat recovery assembly of FIGS. 1 and 2.

By way of example and referring next to FIG. 3, the overall aspects of an embodiment of the heat recovery assembly 100 are illustrated as utilized in an exemplary 80% annual fuel utilization efficiency (AFUE) furnace rated at 100,000 input/80,000 output. Hot, moist, oxygen-starved carbon emissions are extracted from the furnace at approximately 375° F./90% plus humidity/55 CFM. The hot, water-saturated, oxygen starved carbon emissions carry a large heat potential of at least 20,000 British Thermal Units per Hour (BTUH). In addition to heat energy, the water-saturation of the emissions (misting increases this water-saturation) contains high levels of potential energy for extraction. These emissions are then mixed with an oxygen rich, dry, cool fresh air of equal cubic feet per minute (CFM) using pressure regulation in the insulated chamber 110. Within the insulated chamber 110 under controlled conditions, the dry, cool, oxygen rich air is saturated by the misted water within the emissions discharge, resulting in an increase in the dew point. The heat energy released in the emissions (approximately 375° F.) mixes with the cool, fresh air, resulting in a mean temperature of approximately 215° F. The oxygen starved emissions are also replenished with $O_2$, assisting in the heat transfer process. The end result is a warm 215° F./high dew point/high $O_2$/high-energy potential mixture ideal for high efficiency heat and energy extraction.

This mixture passes over the primary heat recovery exchanger 116. The fluid, i.e., refrigerant, in the exchanger 116 is under controlled pressurized conditions and is able to extract a large amount of heat energy from the mixture and transfer the heat energy to the heat extraction exchanger 130 via the fluid circuit 120 such that it can be utilized to warm the indoor air. The flow of refrigerant in the fluid circuit 120 between each of the components of the assembly is illustrated by arrows in FIG. 3. The discharge following the controlled and regulated reaction within the insulated chamber 110 is dry, cool, nearly carbon-free emissions. The average discharge of the resulting emissions is typically 49° F./10% humidity/0.05-0.00 PPM CO (carbon monoxide).

A compressor 150 may be utilized to assist in refrigerant flow between the primary heat recovery exchanger 116 and heat extraction exchanger 130 via the fluid circuit 120. The heating of cooler refrigerant in the primary heat recovery exchanger 116 during the operation of the assembly 100 results in a pressure increase inside the exchanger and the fluid circuit 120, resulting in heat-absorbed refrigerant being pushed to an area of lower pressure (see FIG. 4). This pushing phenomena allows a large part of refrigerant flow in the circuit (approximately 50%) to be achieved without any compressor assistance, limiting the amount of electrical energy required; therefore, a large compressor may not be necessary in most embodiments of the assembly 100 to get sufficient refrigerant flow. As such, a micro-compressor is preferably utilized in embodiments of the invention to further provide energy conservation.

The assembly 100 could be adapted to attach to any age furnace with about 78% AFUE or higher efficiency, resulting in an increased efficiency of the system. Carbon discharge, emission temperature, and humidity may also be reduced if the assembly 100 is utilized with a furnace.

Figure 5:
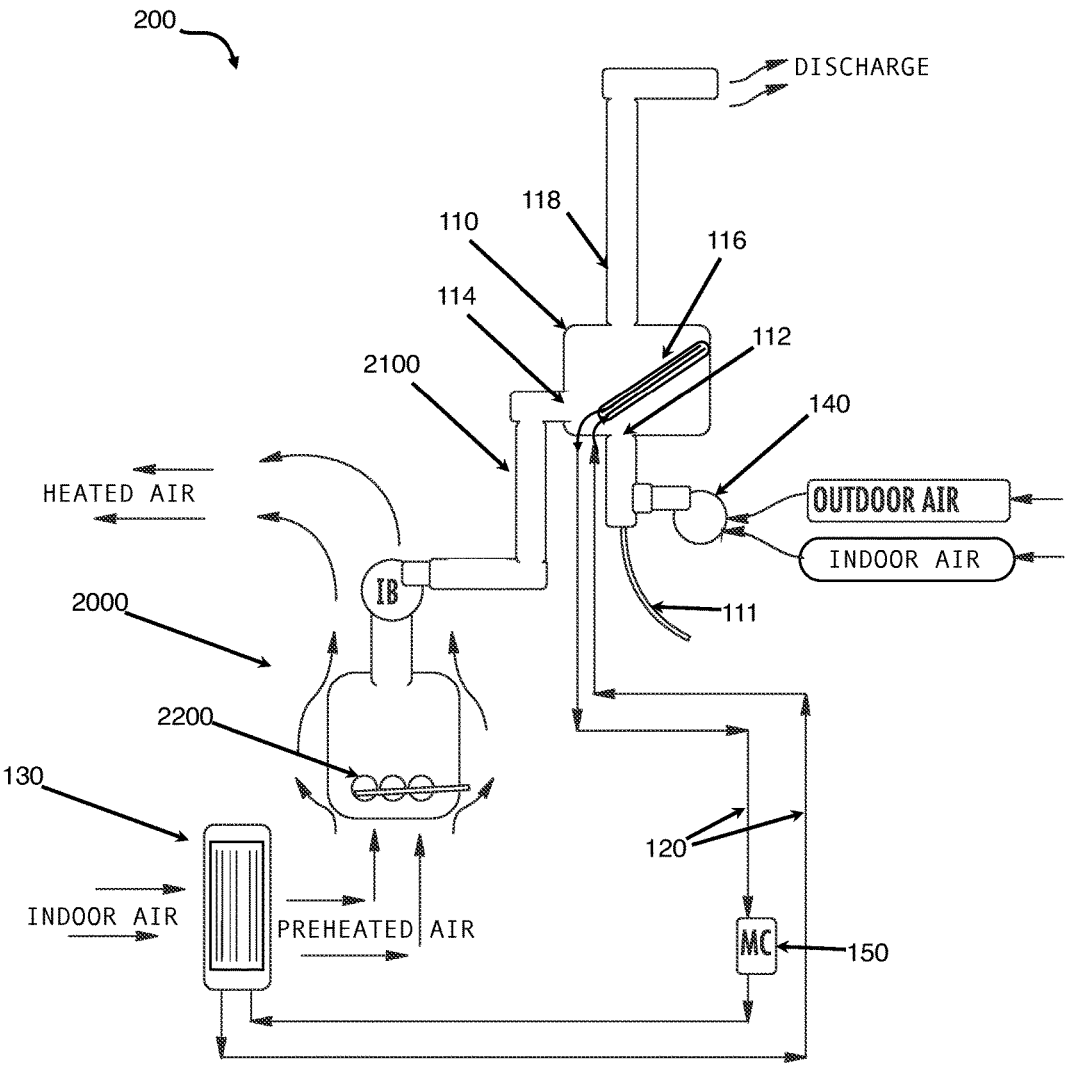
FIG. 5 is an illustration of an embodiment of a heat recovery system of the present invention.
Figure 10:
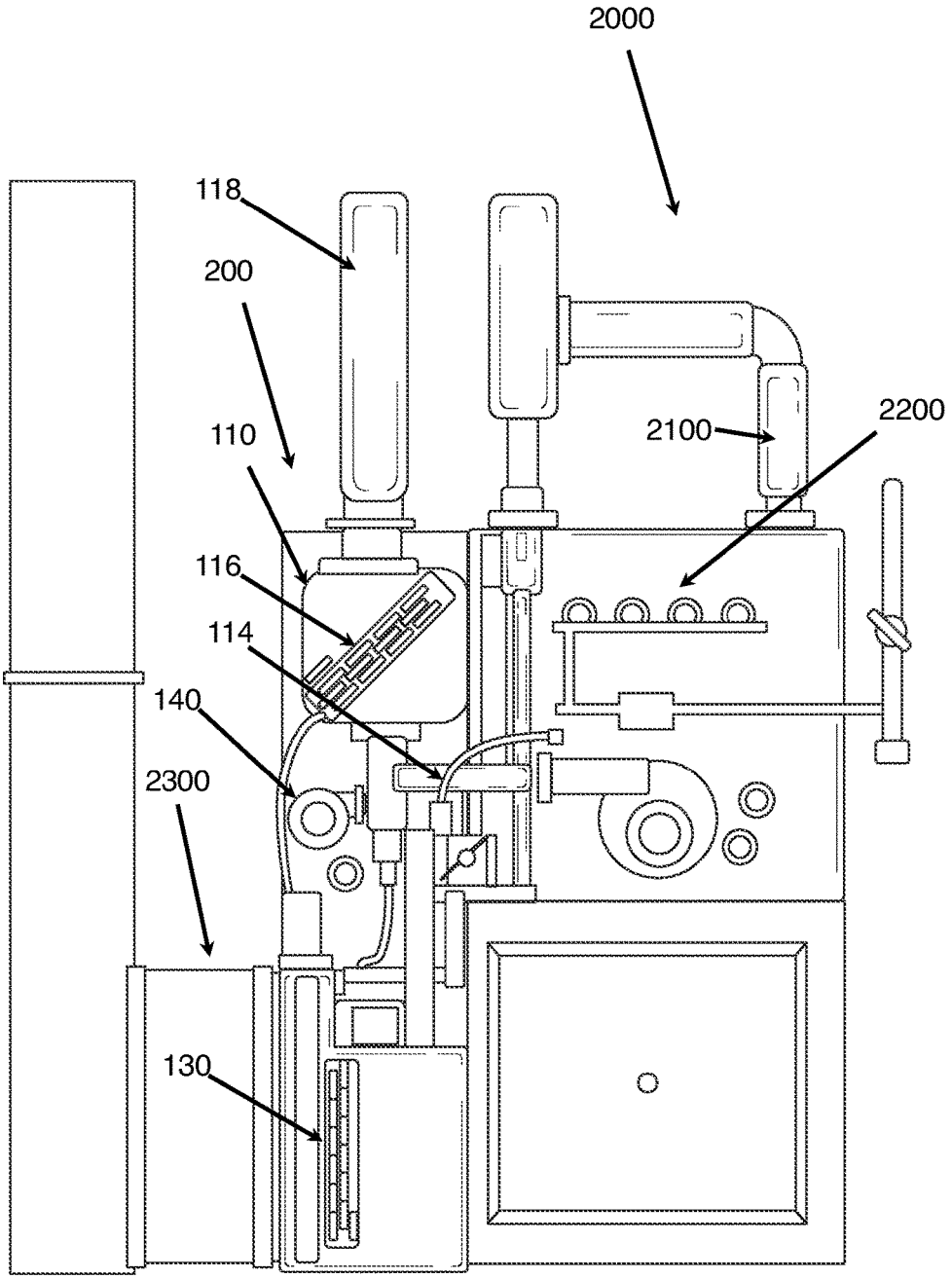
FIG. 10 is an illustration of a cut-away view of the embodiment of a heat recovery system of the present invention illustrated in FIG. 9.

Referring next to FIG. 5 and FIG. 10, a heat recovery system 200 is illustrated. The system 200 includes a furnace 2000 comprising an exhaust 2100 and a furnace intake 2300. The system 200 further includes an insulated chamber 110 comprising an air intake 112 and an emissions intake 114. The emissions intake 114 is adapted to be in communication with the exhaust 2100 of the furnace to receive exhaust gas and waste products resulting from fuel combustion in the furnace 2000. A primary heat recovery exchanger 116 is contained within the insulated chamber 110 and is in fluid communication with a fluid circuit 120 that includes a primary conduit 122 configured to convey a fluid therein, such as a refrigerant. The primary heat recovery exchanger 116 is also configured such that during operation of the furnace 2000 it is in thermal communication with a mixture comprising air introduced via the air intake 112 and exhaust gas and waste products introduced via the emissions intake 114 that is connected to the furnace exhaust 2100.

The system 200 also includes a heat extraction exchanger 130 in fluid communication with the fluid circuit 120 and disposed in thermal communication with an airstream being drawn into the furnace for heating (see INDOOR AIR passing through the heat extraction exchanger 130 in FIG. 5). Refrigerant is heated in the primary heat recovery exchanger 116 and moved to the heat extraction exchanger 130 via the pressure gradient created by the heat exchange and, optionally, with assistance from a micro-compressor or the like, where heat exchange occurs between the airstream flowing from the indoor air source and the heat extraction exchanger 130. The pre-heated air is directed into the heat exchanger 2200 of the furnace such that the air is further heated and then directed into the home or other structure in need of being heated.

Additionally, the system 200 further includes a drain 111 exiting the insulated chamber 110. The drain 111 may be structured as in FIG. 1 or FIG. 2, depending on the type of furnace being utilized in the system 200 (as explained previously herein). As such, a system 200 utilizing the drain 111 as illustrated in FIG. 2 would further include a secondary heat recovery exchanger 117 as previously described herein.

The system 200 may also utilize a compressor 150, as previously described herein. It is preferable that the compressor is a micro-compressor to further aid in energy conservation. It is also contemplated that a furnace inducer blower, IB, may be in connection with the furnace exhaust 2100 to actively draw exhaust from the furnace 2000 into the emission intake 114 of the insulated chamber 110.

The assembly 100 and system 200 of the present invention may further utilize a heat recovery ventilator. Heat recovery ventilators have been a known art in the HVAC industry for many years; however, the typical ventilator is much less efficient and structurally different than the embodiment disclosed in the present invention in combination with the assembly and system herein. A conventional Heat Recovery Ventilator (HRV) draws in fresh outdoor air to replace exhausted indoor air. The HRV helps create air exchanges within home or building structures which in turn helps to reduce pollutants, smoke, contaminants, airborne allergies, viruses, etc. from collecting within the home or building ventilation systems. During the air exchange process of a ventilator, fans and heat exchangers will pass heated or cooled indoor air over unconditioned outdoor air. The two air masses never combine but are separated by heat exchangers. This process can transfer as much as 85% of the heat energy from the conditioned air mass to the unconditioned air mass. About 15% of the energy is lost in this process, causing the home or building owner the expense of heating or air conditioning that loss to the newly introduced unconditioned air in order to maintain the same comfort level within the structure.

Figure 6:
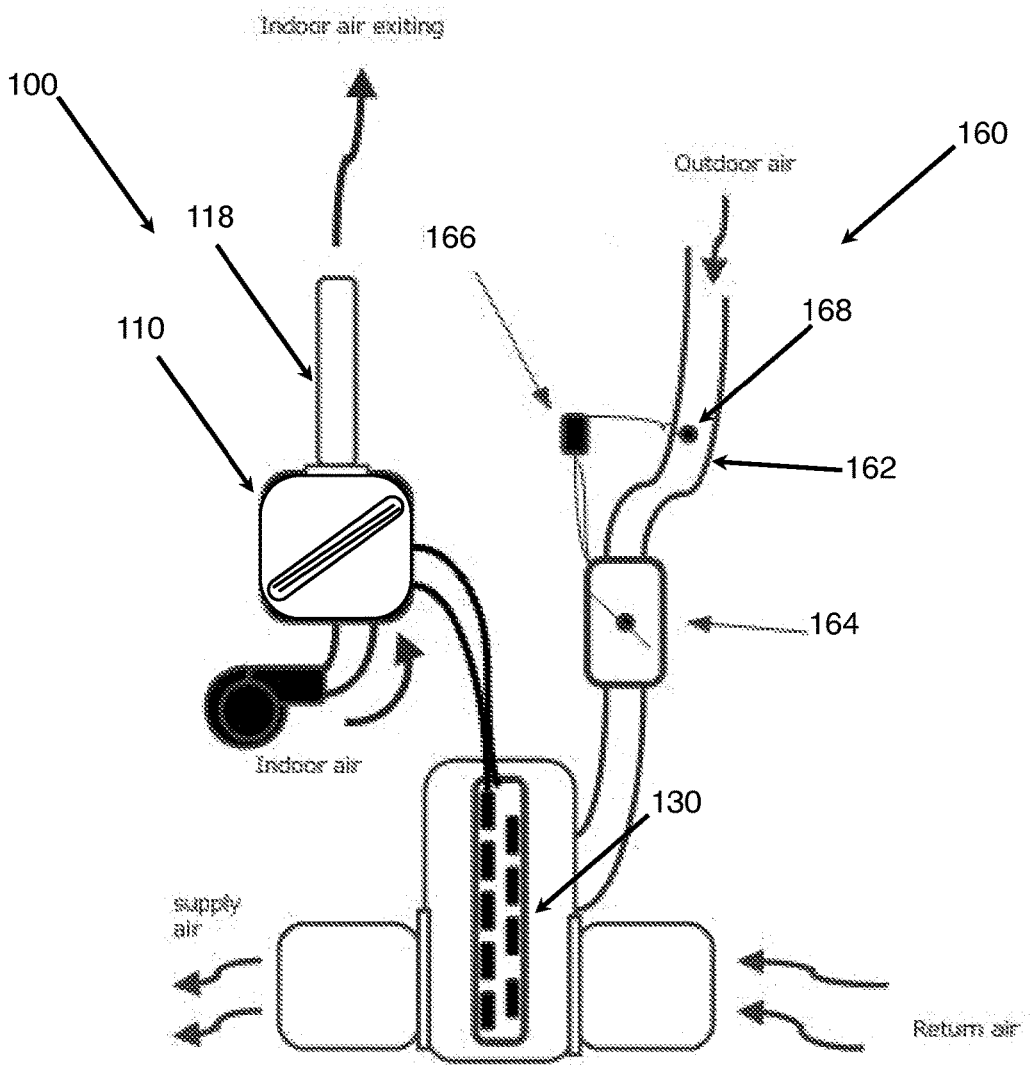
FIG. 6 is an illustration of another embodiment of a heat recovery system utilizing a heat recovery ventilator assembly.

FIG. 6 shows a heat recovery ventilator (HRV) assembly 160 configured in relation to a heat recovery assembly 100 for providing fresh outdoor air to the interior environment. The HRV contains a ventilator outdoor air intake 162 that is structured to be in communication with the heat extraction exchanger 130 for heating outdoor air as it is drawn into the supply air intake of a heating apparatus or furnace. The HRV provides clean, outdoor air for circulation within the home or building. It directs the air into the airstream being drawn across the heat extraction exchanger 130 such that it can be heated by the energy efficient process utilized in the heat recovery assembly 100 or system 200, as previously described herein. The HRV assembly 160 may further include a motorized damper 164 in communication with the outdoor air intake 162 such that the flow of outdoor air is regulated. A thermostat 166 may be in communication with the motorized damper 164 for controlling the opening and closing of the damper 164 based on the outdoor air temperature. Typically, the damper 164 allows air temperatures ranging from about 10 degrees Fahrenheit to about 70 degrees Fahrenheit to pass therethrough. The thermostat 166 utilizes a temperature sensor 168 to communicate the outside air temperature.

Figure 7:
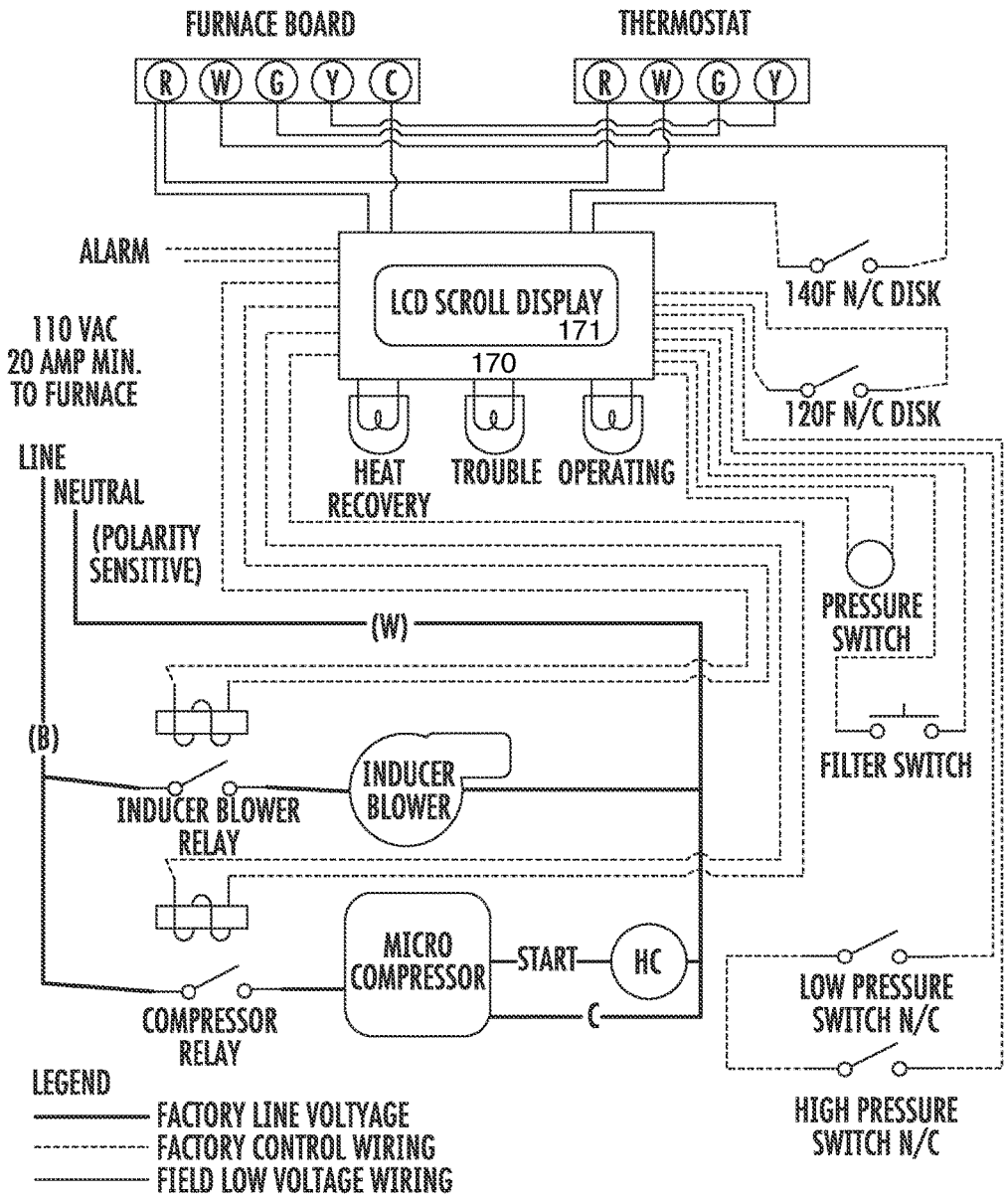
FIG. 7 is an illustration of a wiring diagram of an embodiment of the heat recovery system illustrated in FIG. 5.

FIG. 7 illustrates a typical electrical wiring diagram of a heat and energy recovery system as provided in the present invention. The diagram illustrates the connections between a logic board 170 of the system and the furnace board and thermostat of a typical HVAC system. A LCD scroll display 171 is provided for a visual depiction of the operational parameters of the system. Heat recovery, troubleshooting, and normal operating conditions are indicated by LED lights. Various connections between sensors and switches (e.g., low and high pressure switches) are also depicted. The inducer blower and micro-compressor connections and requisite relays are also depicted. Connections between all components of the system are also wired with the logic board 170 to provide centralized control and functionality of the system.

Figure 8:
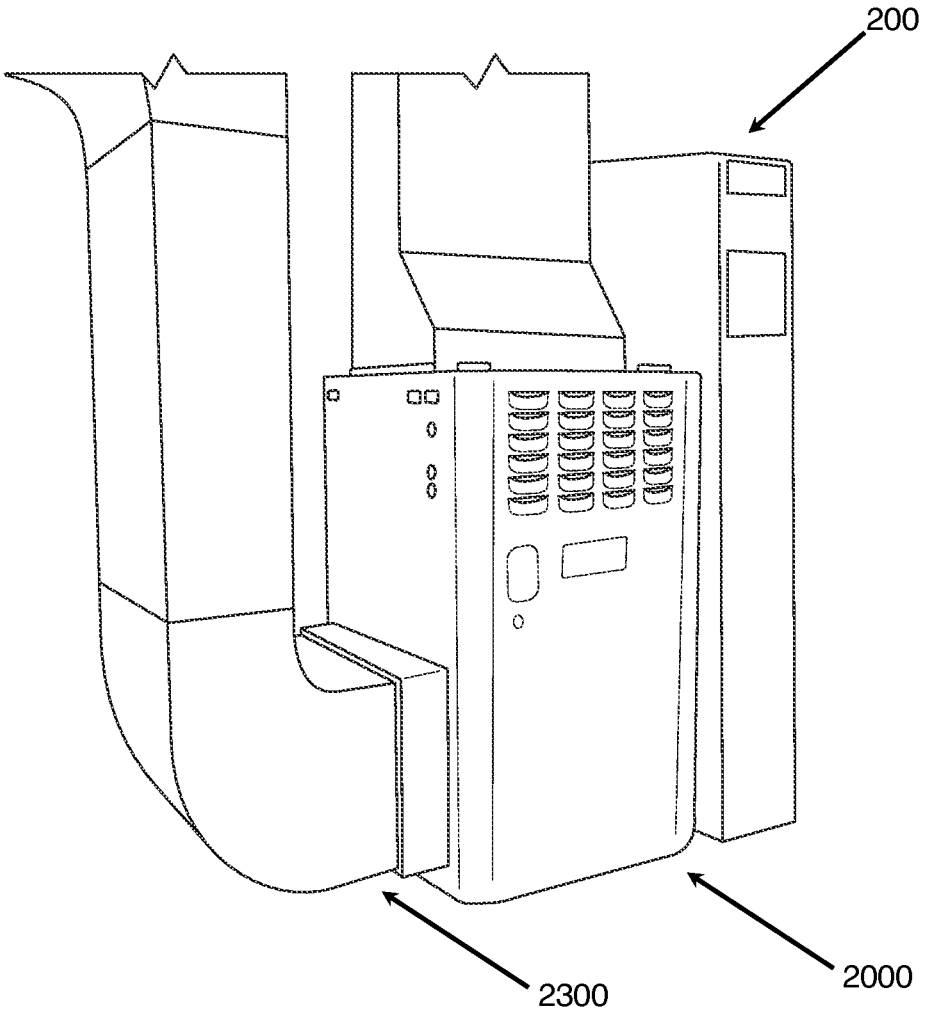
FIG. 8 is a perspective view of an embodiment of the heat recovery system of the present invention.
Figure 9:
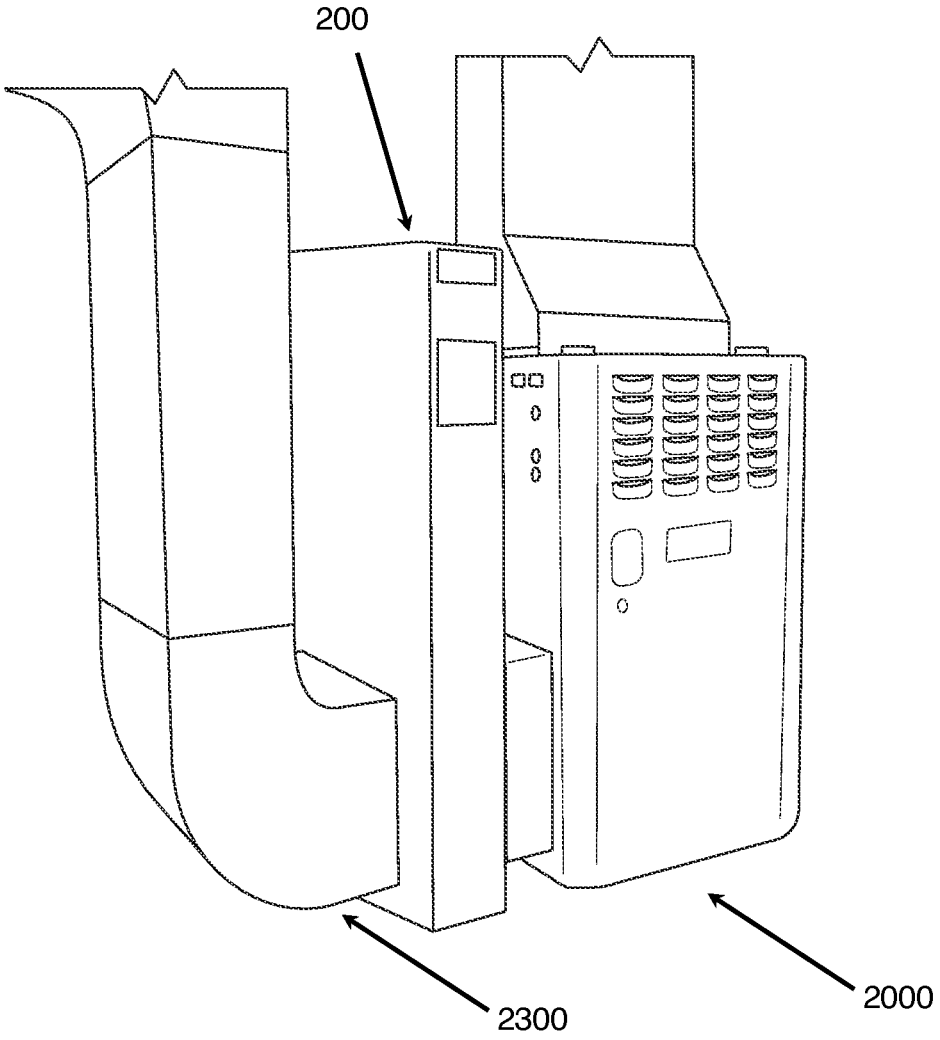
FIG. 9 is a perspective view of another embodiment of the heat recovery system of the present invention.

FIGS. 8 and 9 illustrate typical operational embodiments of the heat and energy recovery system 200 with a furnace 2000. As shown, the system 200 may be adapted to fit on the furnace unit either on a wall of the unit (FIG. 8) or inline with the air intake of the furnace (FIG. 9). A cut-away illustration is shown in FIG. 10 in an embodiment where the system 200 is structured to be inline with the furnace intake 2300 for receiving air as it is drawn into the furnace 2000.

The invention is further directed to a method of recovering heat and energy from fuel combustion. The method includes feeding excess heat and waste products emitted as a result of fuel combustion into an insulated chamber which contains a primary heat recovery exchanger (fluid filled) coupled with a fluid containing conduit circuit. Typically, the fluid comprises a refrigerant. The method further includes feeding air into the insulated chamber to initiate a reaction with the waste products that produces a reaction product with potential energy. Furthermore, the method includes effectuating heat energy exchange through the reaction product and excess heat interacting with the primary heat recovery exchanger. As a result, the temperature and reactive pressure within the primary heat recovery exchanger and fluid containing conduit circuit rises. Finally, the method includes releasing the heat energy by forced air blowing over a heat extraction exchanger that is in fluid communication with the fluid containing conduit circuit exteriorly of the insulated chamber.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A heat recovery assembly, the assembly comprising:

an insulated chamber comprising an air intake, an emissions intake, and an exhaust, the emissions intake for receiving exhaust gas and waste products emitted as a result of fuel combustion and the exhaust for discharging remaining emissions from the insulated chamber, the insulated chamber having a bottom surface over which residual water accumulates from a mist therein;

a primary heat recovery exchanger containing a fluid therein, the primary heat recovery exchanger contained within the insulated chamber for contacting a mixture comprising air introduced via the air intake and exhaust gas and waste products introduced via the emissions intake such that heat exchange is effectuated with the fluid;

a fluid circuit comprising a primary conduit in fluid communication with the primary heat recovery exchanger;

a heat extraction exchanger in fluid communication with the primary heat recovery exchanger via the fluid circuit and for effectuating heat exchange with an airstream running therethrough; and a secondary heat recovery exchanger within the insulated chamber in fluid communication with the primary heat recovery exchanger, the secondary heat recovery exchanger extending over the bottom surface of the insulated chamber and configured to remain at least partially covered by the accumulated residual water.

2. The assembly of claim 1, wherein the air intake is a pressure regulator inducer blower for providing pressurized air into the insulated chamber.

3. The assembly of claim 1, further comprising a mister for providing the mist of water into the insulated chamber.

4. The assembly of claim 1, wherein the fluid conveyed via the fluid circuit comprises a refrigerant.

5. The assembly of claim 1, wherein the primary heat recovery exchanger includes a hermetically sealed coil for effectuating heat exchange with the fluid therein.

6. The assembly of claim 1, further comprising a ventilator outdoor air intake in communication with the heat extraction exchanger for heating outdoor air that passes over the heat extraction exchanger.

7. A heat recovery system, comprising:

a furnace comprising an exhaust and a furnace intake;

an insulated chamber comprising an air intake and an emissions intake, the emissions intake in communication with the exhaust of the furnace for receiving exhaust gas and waste products resulting from fuel combustion and the air intake configured for receiving air from a source of air, the insulated chamber having a bottom surface over which residual water accumulates from a mist therein;

a fluid circuit including a primary conduit configured to convey a fluid therein;

a primary heat recovery exchanger contained within the insulated chamber, the primary heat recovery exchanger in fluid communication with the fluid circuit and configured for thermal communication with a mixture comprising air introduced via the air intake and exhaust gas and waste products introduced via the emissions intake such heat exchange is effectuated with the fluid;

a heat extraction exchanger in fluid communication with the fluid circuit and disposed in thermal communication with an airstream being drawn into the furnace intake for transferring heat energy from the heat extraction exchanger to the airstream; and a secondary heat recovery exchanger within the insulated chamber in fluid communication with the primary heat recovery exchanger, the secondary heat recovery exchanger extending over the bottom surface of the insulated chamber and configured to remain at least partially covered by the accumulated residual water.

8. The heat recovery system of claim 7, wherein the air intake is a pressure regulator inducer blower for providing pressurized air into the insulated chamber.

9. The heat recovery system of claim 7, further comprising a mister for providing the mist of water into the insulated chamber.

10. The heat recovery system of claim 7, wherein the fluid conveyed via the fluid circuit comprises a refrigerant.

11. The heat recovery system of claim 7, wherein the primary heat recovery exchanger includes a hermetically sealed coil for effectuating heat exchange with the fluid therein.

12. The heat recovery system of claim 7, further comprising a ventilator outdoor air intake in communication with the heat extraction exchanger for heating outdoor air as it is drawn into the furnace.

13. The heat recovery system of claim 12, further comprising a motorized damper in communication with the ventilator outdoor air intake such that the flow of outdoor air is regulated.

14. The heat recovery system of claim 13, further comprising a thermostat for controlling the motorized damper based on the outdoor air temperature.

15. A method of recovering heat and energy using the assembly of claim 1, the method comprising:

feeding excess heat and waste products emitted as a result of fuel combustion into the insulated chamber;

feeding air into the insulated chamber for initiating a reaction with the waste products to produce a reaction product with potential energy;

effectuating heat energy exchange through the reaction product and excess heat interacting with the primary heat recovery exchanger, whereby the temperature and reactive pressure of the fluid within the primary heat recovery exchanger and conduit circuit rises; and extracting heat from the residual water that accumulates from the mist via the secondary heat recovery exchanger within the insulated chamber;

releasing the heat energy by forcing air over a heat extraction exchanger that is in fluid communication with the fluid containing conduit circuit exteriorly of the insulated chamber.

* * * * *